US011697977B2

(12) United States Patent
Al Haji

(10) Patent No.: US 11,697,977 B2
(45) Date of Patent: Jul. 11, 2023

(54) ISOLATION VALVE FOR USE IN A WELLBORE

(71) Applicant: Saudi Arabian Oil Company, Dhahran (SA)

(72) Inventor: Ahmed Mohammed Al Haji, Al Umran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 234 days.

(21) Appl. No.: 17/149,513

(22) Filed: Jan. 14, 2021

(65) Prior Publication Data

US 2022/0220826 A1 Jul. 14, 2022

(51) Int. Cl.
*E21B 34/12* (2006.01)
*E21B 34/14* (2006.01)

(52) U.S. Cl.
CPC ..... *E21B 34/12* (2013.01); *E21B 34/14* (2013.01); *E21B 2200/05* (2020.05)

(58) Field of Classification Search
CPC ..... E21B 34/14; E21B 2200/05; E21B 34/12; E21B 2200/03; E21B 2200/04
See application file for complete search history.

(56) References Cited

U.S. PATENT DOCUMENTS

| | | | | |
|---|---|---|---|---|
| 2,853,265 | A | 9/1958 | Clark | |
| 2,912,216 | A | 11/1959 | Conrad | |
| 3,036,810 | A | 5/1962 | Conrad et al. | |
| 3,981,358 | A | 9/1976 | Watkins et al. | |
| 4,427,071 | A | 1/1984 | Carmody | |
| 4,629,222 | A | 12/1986 | Dearden et al. | |
| 4,732,416 | A | 3/1988 | Dearden et al. | |
| 4,984,829 | A | 1/1991 | Saigo | |
| 5,070,944 | A * | 12/1991 | Hopper | E21B 34/066 251/129.21 |
| 5,823,265 | A | 10/1998 | Crow et al. | |

(Continued)

FOREIGN PATENT DOCUMENTS

| | | | |
|---|---|---|---|
| CA | 2433703 | A1 | 12/2003 |
| EP | 1069279 | A2 | 1/2001 |

OTHER PUBLICATIONS

International Search Report and Written Opinion for PCT Application No. PCT/PCT/US2022/012401 dated Mar. 18, 2022.

*Primary Examiner* — Robert E Fuller
(74) *Attorney, Agent, or Firm* — Bracewell LLP; Constance G. Rhebergen; Keith R. Derrington

(57) ABSTRACT

A portion of a wellbore is put into communication or is isolated by selectively applying an axial or rotational force downhole. The axial force moves a shifting sleeve and deployment sleeve from an initial position to an opening position causing a valve element to move into an open configuration and allowing communication to the portion of the wellbore. The shifting sleeve is returned to the initial position and separated from the deployment sleeve, which is anchored to a retraction sleeve adjacent the valve element. Threads on the shifting and retraction sleeves become engaged when the deployment sleeve is moved to the opening position. The retraction sleeve is rotated by rotating the shifting sleeve, threaded engagement with the rotating retraction sleeve draws the deployment sleeve away from the valve element, and allows the valve element to move to a closed configuration.

20 Claims, 5 Drawing Sheets

(56) References Cited

U.S. PATENT DOCUMENTS

| | | | | |
|---|---|---|---|---|
| 6,328,111 | B1 * | 12/2001 | Bearden | E21B 23/02 166/381 |
| 6,877,564 | B2 | 4/2005 | Layton et al. | |
| 7,011,344 | B1 | 3/2006 | Bakke | |
| 7,086,669 | B2 | 8/2006 | Evans et al. | |
| 7,213,655 | B2 | 5/2007 | Parrott | |
| 7,360,600 | B2 | 4/2008 | MacDougall et al. | |
| 7,451,809 | B2 | 11/2008 | Noske et al. | |
| 7,537,062 | B2 | 5/2009 | Hughes et al. | |
| 8,499,840 | B2 | 8/2013 | Bennett et al. | |
| 8,701,781 | B2 | 4/2014 | Henschel | |
| 11,319,773 | B2 * | 5/2022 | Candido Gomes | E21B 34/066 |
| 2006/0071474 | A1 | 4/2006 | Hallett et al. | |
| 2011/0017448 | A1 * | 1/2011 | Pipchuk | E21B 49/00 166/241.5 |
| 2015/0226030 | A1 | 8/2015 | Mackenzie et al. | |
| 2016/0145970 | A1 | 5/2016 | Armistead | |

* cited by examiner

ISOLATION VALVE FOR USE IN A WELLBORE

BACKGROUND OF THE INVENTION

1. Field of Invention

The present disclosure relates to isolating flow within a wellbore with a valve that is actuated between open and closed configurations in response to forces that are applied axially and rotationally.

2. Description of Prior Art

Hydrocarbons are typically produced from subterranean formations by excavating wellbores that penetrate the formations and completing the wellbores to form a producing oil well. Completing an oil well generally includes lining at least a portion of the wellbore with casing, cementing the casing in place, and perforating through the casing and into the surrounding formation to allow fluid communication from the formation to inside of the wellbore. Formation fluid entering the wellbore is usually routed to surface via a string of production tubing ("production string") that is installed in the wellbore after the step of perforating.

Sometimes valves are installed within the wellbore for controlling flow into or through the production tubing. One type of downhole valve is an inflow control valve ("IFD") for controlling flow entering the production tubing, and is often employed to regulate an amount of fluid entering into a portion of the production string; such as for balancing flow when fluids entering separate sections of the production string are at different pressures. In other instances an IFD is substantially or fully closed to limit or block an inflow of water or other undesired substances. Safety valves make up another type of valves installed downhole, and which are used to block flow through production tubing and isolate all or a portion of the subterranean formation from surface. As their name implies safety valves are for use in emergency situations, such as a loss of containment downstream or unexpectedly high pressures in the formation. Safety valves typically operate similar to a check valve and are often designed in a fail-safe mode; and unless a force is applied to hold them in an open configuration, they will usually revert to a closed configuration when exposed to a flow of fluid inside the production string towards surface and isolate the upstream formation from surface. Usually hydraulic fluid or electricity is employed to generate the force to hold the safety valve in the open configuration; a drawback of this is that interruption of the supply of hydraulic fluid or electricity will allow the safety valve to close, which threatens the flow of production fluid.

SUMMARY OF THE INVENTION

Disclosed herein is an example of a system for isolating a portion of a wellbore and that includes a housing, a valve element selectively changeable between a closed configuration and positioned in a path of fluid flow in the wellbore to define a barrier to fluid flow in the wellbore, and an open configuration and positioned away from the path of fluid flow in the wellbore. The system also includes a deployment sleeve axially moveable within the housing and selectively positioned adjacent the valve element when the valve element is in the open configuration and which interferes with the valve element being changed to the closed configuration, and a retraction sleeve disposed in the housing that is in lifting engagement with the deployment sleeve when the deployment sleeve is positioned adjacent the valve element, so that when the retraction sleeve is rotated an elevational force is exerted onto the deployment sleeve to move the deployment sleeve away from the valve element. The system optionally includes a generally helical flight assembly coupled between the retraction sleeve and deployment sleeve, and through which the elevational force is transmitted from the retraction sleeve to the deployment sleeve, in an alternative the helical flight assembly is a flight element that is mounted along a surface of the retraction sleeve that circumscribes an axis of the housing. In an embodiment another flight element is mounted along a surface of the deployment sleeve that circumscribes an axis of the housing and that engages the flight element when the retraction sleeve is in lifting engagement with the deployment sleeve, and where one of the flight elements is radially compressible. Some examples include a shifting sleeve that is axially moveable within the housing and that is in abutting contact with the deployment sleeve so that sliding the shifting sleeve within the housing towards the deployment sleeve positions the deployment sleeve adjacent the valve element, and wherein the shifting sleeve is freely moveable away from the deployment sleeve in a direction away from the valve element. The system alternatively further includes a shifting sleeve that is axially moveable with respect to the retraction sleeve and rotationally coupled with the retraction sleeve by a pin and slot arrangement. In one example the valve element is a disk like member that is hingedly affixed to an inner surface of the housing. In an alternative the deployment sleeve is rotationally coupled with the valve element when the valve element is in the open configuration. Rotationally coupling the valve element and deployment sleeve optionally involves insertion of a spline that projects radially outward from an outer surface of the deployment sleeve into a groove formed on a planar surface of the disk like member. The system alternatively includes a string of production tubing that is rotationally coupled with the retraction sleeve and axially coupled with the deployment sleeve.

Another example of a system for isolating a portion of a wellbore is disclosed and which includes a string of production tubing, an isolation valve assembly comprising, a housing having an uphole end coupled with the string of production tubing and an opening in communication with the wellbore on a downhole end that is distal from the uphole end, a shifting sleeve axially moveable within the housing, a valve element in the housing moveable from a closed configuration to an open configuration in response to downhole movement of the shifting sleeve, a retraction sleeve having a helical thread that circumscribes an axis of the housing, and a deployment sleeve that is selectively moveable downhole with downhole movement of the shifting sleeve to an opening location that interferes with movement of the valve element from the open configuration to the closed configuration, and into anchoring engagement with the helical thread, and a packer assembly circumscribing the housing. In this example the shifting sleeve includes a main body and a collar that circumscribes a portion of the main body to define an annular gap between the main body and collar. In an example the retraction sleeve is made up of a primary section and a bushing coaxially within the primary section to define an annular space between the primary section and the bushing, wherein the collar inserts into the annular space and the bushing inserts into the annular gap. The shifting sleeve and retraction sleeve are optionally rotationally coupled by a pin attached to the collar that inserts into a slot formed axially along a length of the bushing. In one embodiment the shifting sleeve includes a shoulder having a radial surface that is in abutting contact with an end of the deployment sleeve when the shifting sleeve is being moved downhole.

Another example of a system for isolating a portion of a wellbore is disclosed herein and that includes a housing selectively anchored in the wellbore and having a bore, a valve element in the housing that is selectively in a closed position that is in interfering contact with flow through the bore, and selectively in an opened position that is away from interfering contact with the flow, a deployment sleeve in the housing for selectively maintaining the valve element in the opened position, a means for axially urging the deployment sleeve into a position for maintaining the valve element in the opened position, a means for securing the deployment sleeve in the position for maintaining the valve element in the opened position and that comprises a helical member, and a means for retracting the deployment sleeve from the position for maintaining the valve in the opened position by rotating the helical member with respect to the deployment sleeve to generate a lifting force that urges the deployment sleeve axially away from the valve element and out of interference with the valve element moving into the closed position. In an example the helical member is a first helical member, and wherein the means for retracting the deployment sleeve also includes a second helical member that engages the first helical member. In an alternative the helical member is mounted to an inner circumference of a retraction sleeve that is rotationally coupled to a string of production tubing. The means for axially urging the deployment sleeve into a position for maintaining the valve element in the opened position optionally involves a shifting sleeve that is axially moveable within the housing and includes a collar with a downward facing shoulder that is in abutting contact with an end of the deployment sleeve, and wherein a portion of the shifting sleeve inserts into and past the deployment sleeve into contact with the valve element and urges the valve element into the opened position when urged axially downhole. In an alternative, the means for retracting the deployment sleeve from the position for maintaining the valve in the opened position includes the shifting sleeve and a retraction sleeve that is rotationally coupled to the shifting sleeve and wherein the helical member comprises threads that are formed on an inner circumference of the retraction sleeve and that engage threads on an outer circumference of the deployment sleeve when the deployment sleeve is axially urged into the position for maintaining the valve element in the opened position, and wherein the threads on the outer circumference of the deployment sleeve are compressed radially inward when being engaged with the threads on the retraction sleeve.

BRIEF DESCRIPTION OF DRAWINGS

Some of the features and benefits of the present invention having been stated, others will become apparent as the description proceeds when taken in conjunction with the accompanying drawings, in which.

Figure 1:
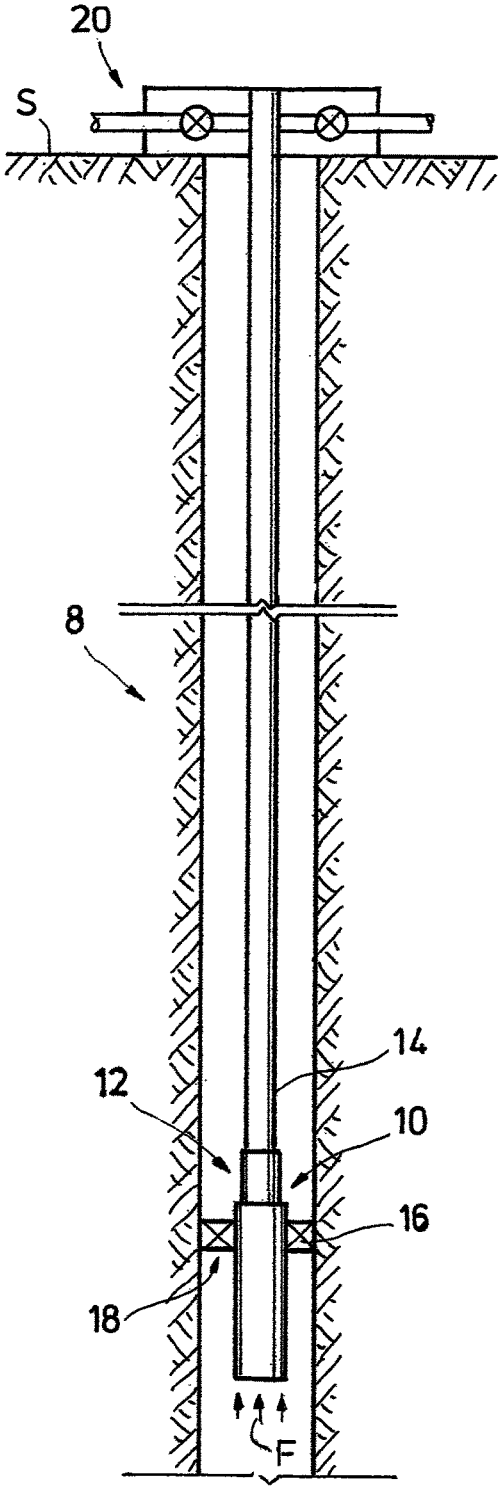
FIG. 1 is a side partial sectional view of an example of an isolation valve disposed in a wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in a partial side sectional view FIG. 1 is an example of a downhole assembly 8 and include a valve assembly 10 disposed in a wellbore 12 and deployed on an end of a production string 14. A packer 16 is shown circumscribing valve assembly 10 and which defines a barrier to flow in an annulus 18 between the valve assembly 10 and sidewalls of wellbore 12. An end of the production string 14 opposite valve assembly 10 is anchored within a wellhead assembly 20 shown mounted on a surface S. In the example shown, valve assembly 10 is used to selectively isolate portions of wellbore 12 from surface S. In the example of FIG. 1, a flow of fluid F shown directed into a lower end of valve assembly 10, when in a closed configuration valve assembly 10 selectively forms a barrier between the production string 14 and wellbore 12 to flow of fluid F; and when in an opened position does not impede the flow of fluid F from passing through valve assembly 10 and entering the production string 14.

Figure 2:
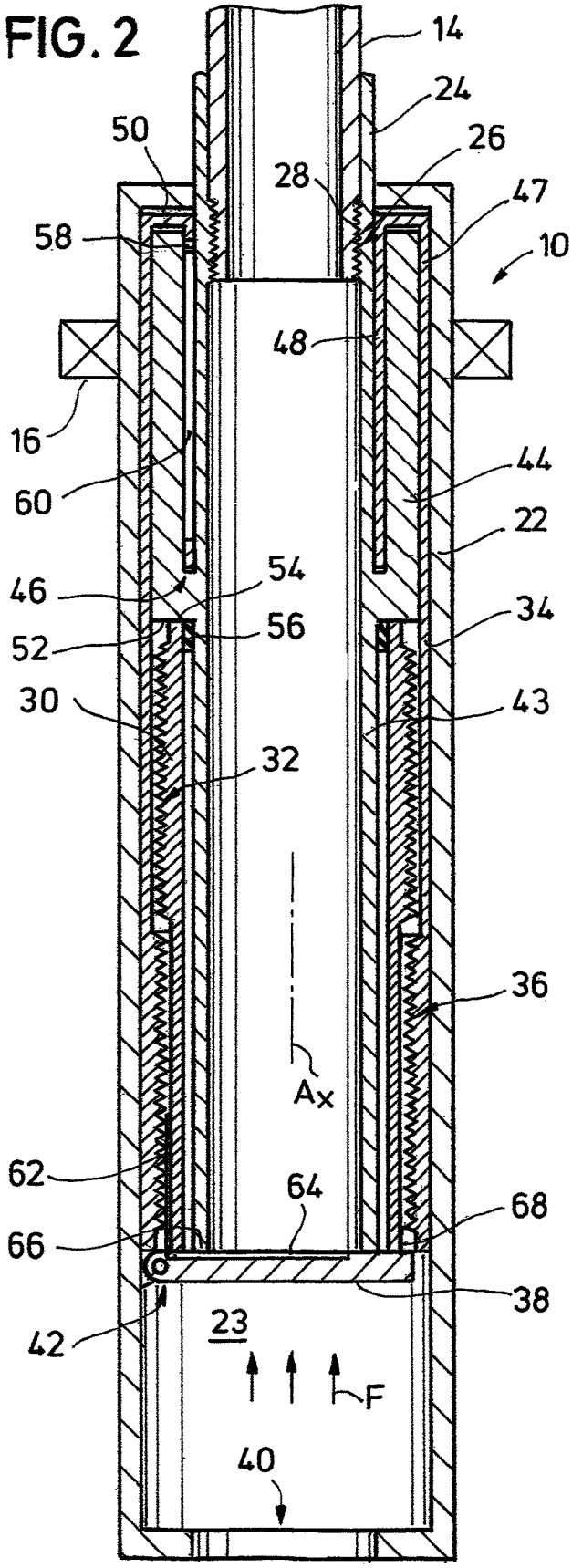
FIGS. 2-8 are side sectional views of examples of operation of the isolation valve of FIG. 1.

An example of the valve assembly 10 is shown in side sectional view in FIG. 2 and including an outer housing 22 with an inner bore 23 extending along its axis $A_X$. Valve assembly 10 of FIG. 2 includes an annular shifting sleeve 24 and with threads 26 along a portion of its inner circumference that engage threads 28 formed on an outer surface of production tubing 14 on its lower end. The embodiment shown also includes an annular deployment sleeve 30 that circumscribes a portion of the shifting sleeve 24, and that has threads 32 formed along a portion of the outer circumference of the deployment sleeve 30. Coaxially circumscribing deployment sleeve 30 is an example of a retraction sleeve 34 having a portion with threads 36 disposed on an inner circumference of the retraction sleeve 34, in the example of FIG. 2 threads 36 are set downhole of the threads 32 on the deployment sleeve 30. For the purposes of discussion herein, "downhole" from a referenced location refers to a region of the wellbore 12 (FIG. 1) in a direction away or side of referenced location opposite surface S, and "uphole" refers to a region of the wellbore 12 in a direction towards the surface S from the referenced location. The example of FIG. 2 also includes a valve element 38 and shown in a closed configuration. Valve element 38 is represented as a flapper valve and with a generally planar configuration, alternate embodiments of the valve element 38 include a bull valve or a butterfly valve. In the example shown when in the closed configuration valve element 38 spans the bore 23 in an orientation substantially perpendicular to an axis $A_X$ of the valve assembly 10 and defines a barrier to fluid flow F axially through the bore 23.

An opening 40 is shown through a sidewall of housing 22 and on an end of housing 22 opposite from where housing 22 connects with the production tubing 14. In the alternative shown, opening 40 provides a way for the flow of fluid F to enter into the valve assembly 10 and from within wellbore 12. A hinge assembly 42 is depicted on an end of valve member 38 and as described in more detail below, provides a place upon which valve element 38 pivots between the closed configuration of FIG. 2 and into an open configuration which puts the valve member 38 out of the path of the flow of fluid F and allowing the flow of fluid F to travel upwards within bore 23 and into production tubing 14. In an alternative, a closing spring (not shown) is included with the hinge assembly 42 and which provides a force for biasing the valve element 38 into the closed configuration, i.e., a clockwise direction pivoting about hinge assembly 42.

The example of the shifting sleeve 24 of FIG. 2 includes a main body 43 which is a substantially tubular section, and an annular collar 44 that circumscribes an uphole portion of the main body 43. An inner circumference of the collar 44 is set radially outward from main body 43 to define a gap 46 between these two members. In the example shown, gap 46 is open on its uphole end and closed on its downhole end where the main body 43 and collar 44 are engaged with one another. Embodiments of the shifting sleeve 24 include a uni-body construction with the main body 43 and collar 44 being a single unit, alternatively the collar 44 is affixed to the main body 43 such as by a threaded fitting (not shown) a weld, fasteners, or any other currently known or later developed means of attachment.

Still referring to the example of FIG. 2, retraction sleeve 34 includes an annular primary portion 47 and a bushing 48 that mounts to an uphole end of the primary portion 47. Bushing 48 is an annular member and spaced radially inward from primary portion 47 and defines an annular space 50. In the example shown collar 44 inserts into annular space 50 in an arrangement analogous to an annular piston (collar 44) within an annular cylinder (annular space 50); similarly bushing 48 is analogous to an annular piston and inserted within gap 46, illustrated analogous to an annular cylinder. An axial end of collar 52 distal from production tubing 14 is shown as a radial surface that is facing downhole and which defines a shoulder 52, in the example of FIG. 2 shoulder 52 is in abutting contact with an uphole end 54 of deployment sleeve 30. Radially inward from end 54 an annular gap exists between deployment sleeve 30 and an outer surface of main body 43. A seal element 56 is disposed within the gap to provide a sealing function between these two surfaces.

A pin 58 is illustrated mounted on an inner surface of collar 44 and shown projecting radially inward through a slot 60 that extends axially along a portion of a sidewall of the bushing 48. Interaction between the pin 58 and slot 60 rotationally couple the collar 44 and bushing 48 and allow a range of axial movement between collar 44 and bushing 48. In the illustrated embodiment, coupling of the collar 44 and bushing 48 respectively with shifting sleeve 24 and retraction sleeve 34 rotationally couples sleeves 24, 34 and allows free axial movement of the sleeves 24, 34 along an axial distance. Further in the example shown a spline 62 is formed along an outer surface of the retraction sleeve 30 and proximate an end adjacent the valve member 38, spline 62 as shown is an elongated member oriented generally parallel with axis $A_X$. As will be described in more detail below, spline 62 is formed to engage a channel 64 shown formed along an uphole facing surface of the valve element 38. As noted above, the configuration of the valve assembly 10 is in the closed configuration and with a lower end 66 of shifting sleeve 24 adjacent to or in contact with the uphole facing surface of valve element 38. A lower end 68 of deployment sleeve 68 is also shown adjacent to or in contact with the uphole facing surface of the valve element 38.

Figure 3:
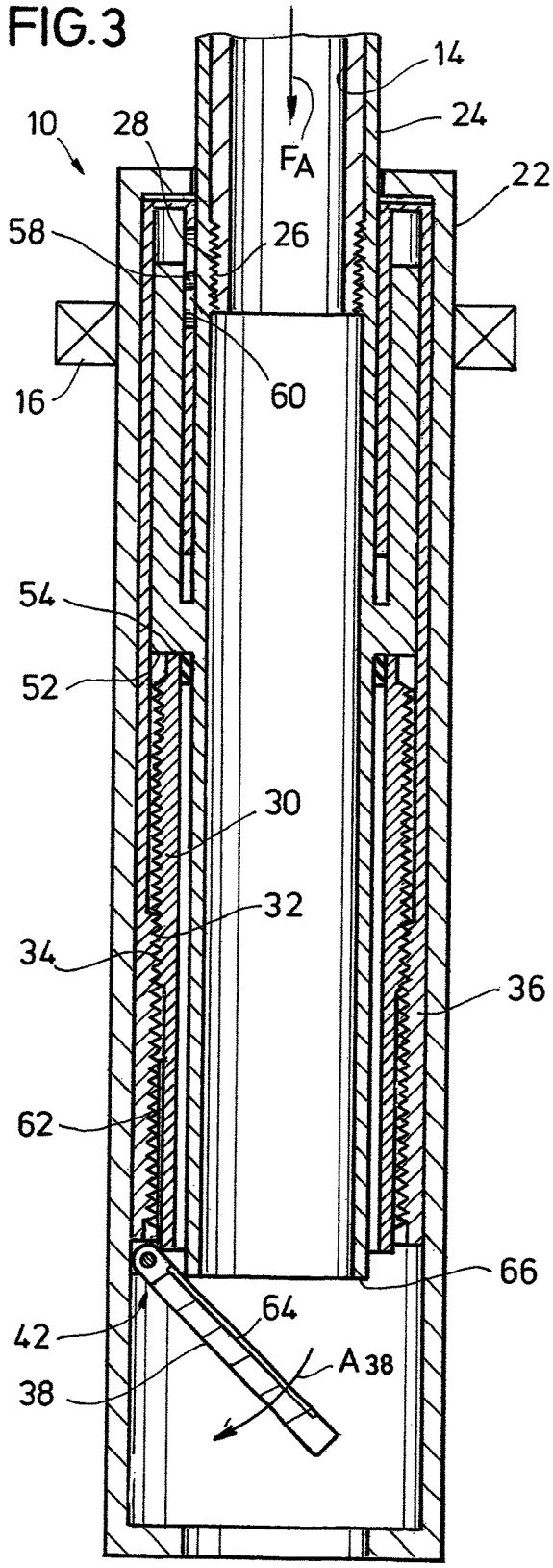

Referring now to FIG. 3, illustrated in a side sectional view is an example step of reconfiguring the valve assembly 10 from a closed configuration into an open configuration to allow a flow of fluid therethrough. A force $F_A$ is schematically illustrated being applied in an axial direction to the production tubing 14 through its threaded coupling to shifting sleeve 24 via threads 26, 28, and in turn exerts a force onto shifting sleeve 24 to urge shifting sleeve 24 in a direction downhole. In an example force $F_A$ is applied to production tubing 14 from a hoisting system (not shown) included with a drilling rig on surface. Downhole movement of the shifting sleeve 24 applies a force onto the valve element 38 causing it to pivot towards an open configuration and in a motion represented by arrow $A_{38}$. Force from the shifting sleeve 24 is exerted to the valve element 38 from the lower end 66 of the shifting sleeve 24. Further shown is that the abutting contact between shoulder 52 and end 54 also slides the deployment sleeve 30 a distance downhole and partially engages threads 32 on shifting sleeve 30 with threads 36 on the retraction sleeve 34. In one example, threads 32 are radially compressible when pushed axially into contact with threads 36 on the retraction sleeve 34 which provides for threaded engagement between threads 32, 36 by an applied axial force to one or both of shifting sleeve 30 and retraction sleeve 34. In an example sleeve 30 includes a section or sections that are biased radially outward by an underlying spring or springs (not shown); in this example and compress the threads 32 by applying a radial inward force exceeding a spring constant of the underlying spring onto threads 32 formed on the section or sections elastically urges the section or sections radially inward deforming the underlying spring.

Figure 4:
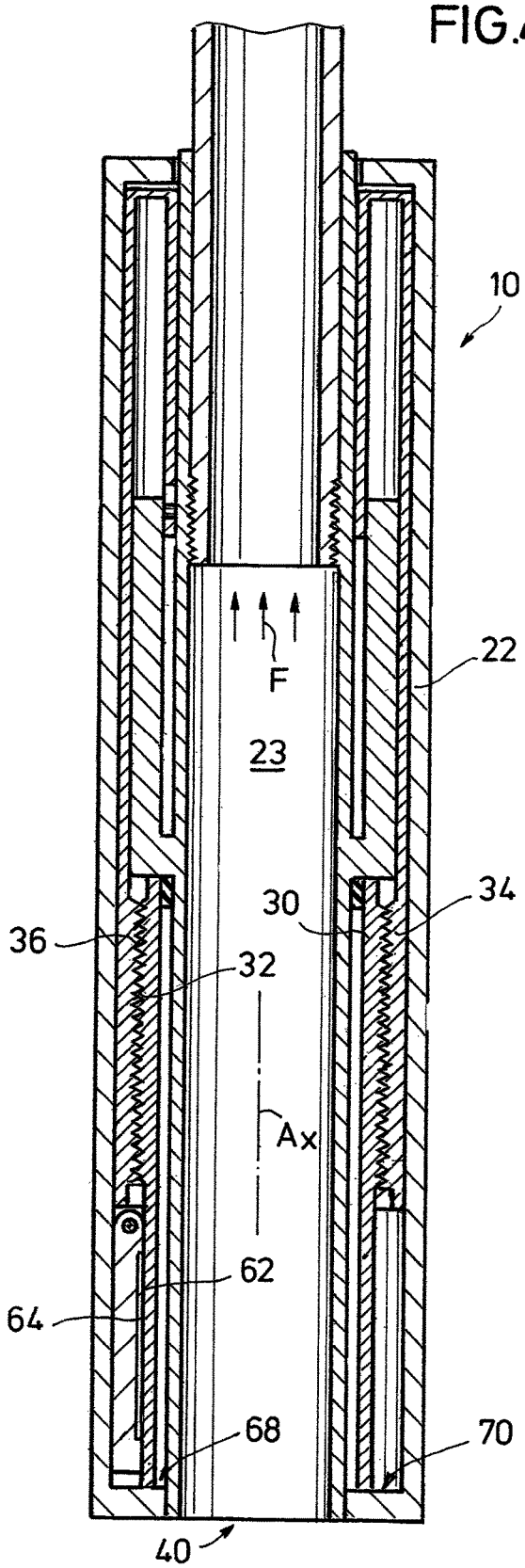

Referring now to FIG. 4, shown in a side sectional view is an example step of operation and subsequent to the application of axial force to the production string 14 such that a portion of the main body 43 of the shifting sleeve 24 is moved downhole entirely past the valve element 38. Abutting contact between the shoulder 52 and end 54 of the deployment sleeve 30 moves deployment sleeve 30 farther downhole so that threads 32, 36 are substantially engaged with one another along their respective axial lengths and which retains the deployment sleeve 30 in its axial location and adjacent to the valve member 38. Valve member 38 is shown pivoted and set against a sidewall of housing and fully away from bore 23 and into its open configuration which is out of the path of the flow of fluid F through the valve assembly 10. In a non-limiting example, the location of the deployment sleeve 30 as shown in FIG. 4 is referred to as an opening location. While in the opening location the deployment sleeve 30 is in interfering contact with the valve element 38 and blocks return of the valve element 38 to the closed configuration of FIG. 2. In a non-limiting example of operation, the valve assembly 10 is maintained in the configuration of FIG. 4 for a period of time during which portions of the wellbore 12 (FIG. 1) downhole of the valve assembly 10 and the surface S (FIG. 1) are in full communication with one another and isolation is not taking place.

Figure 5:
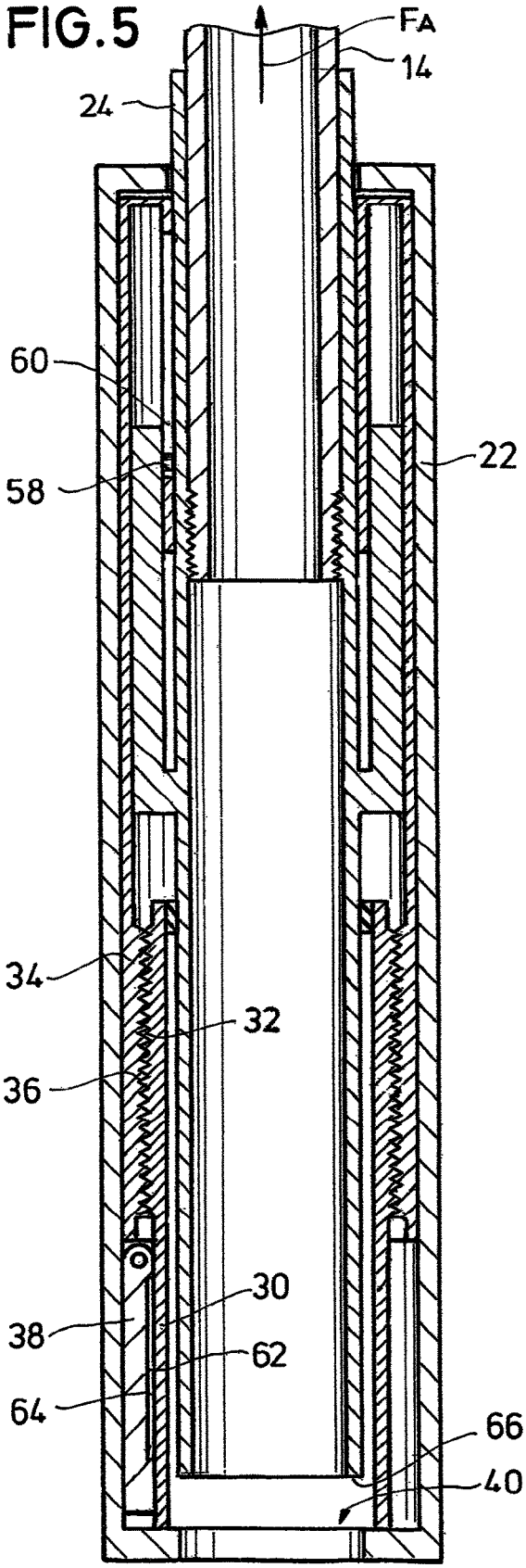
Figure 6:
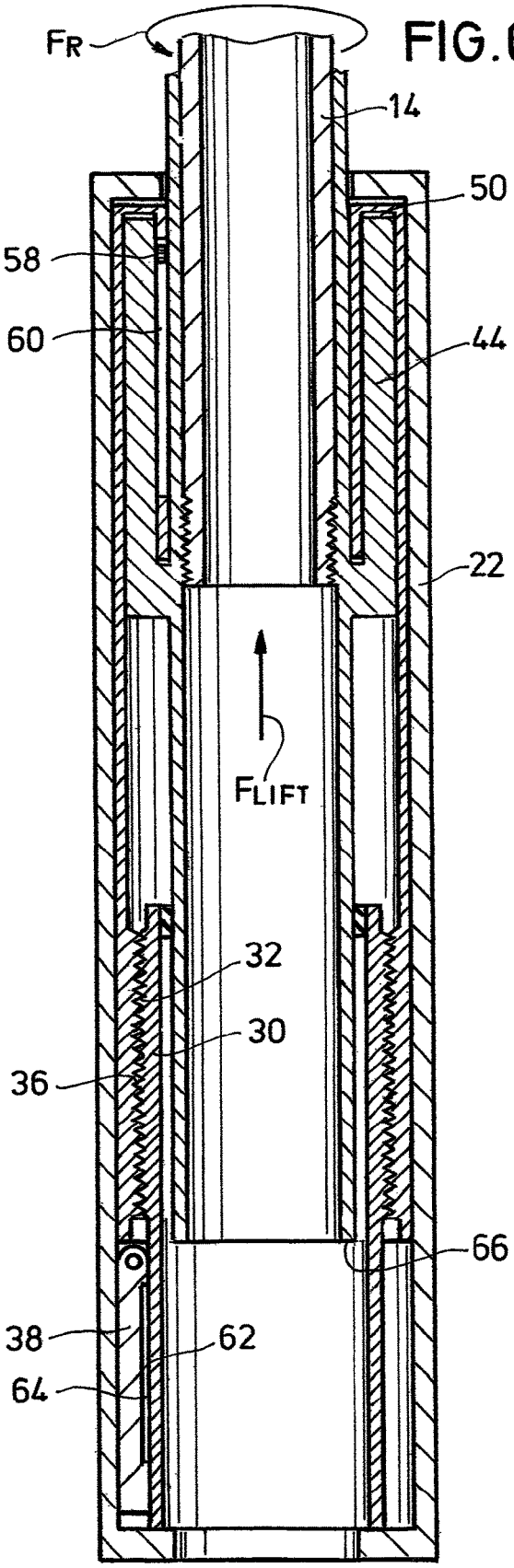
Figure 7:
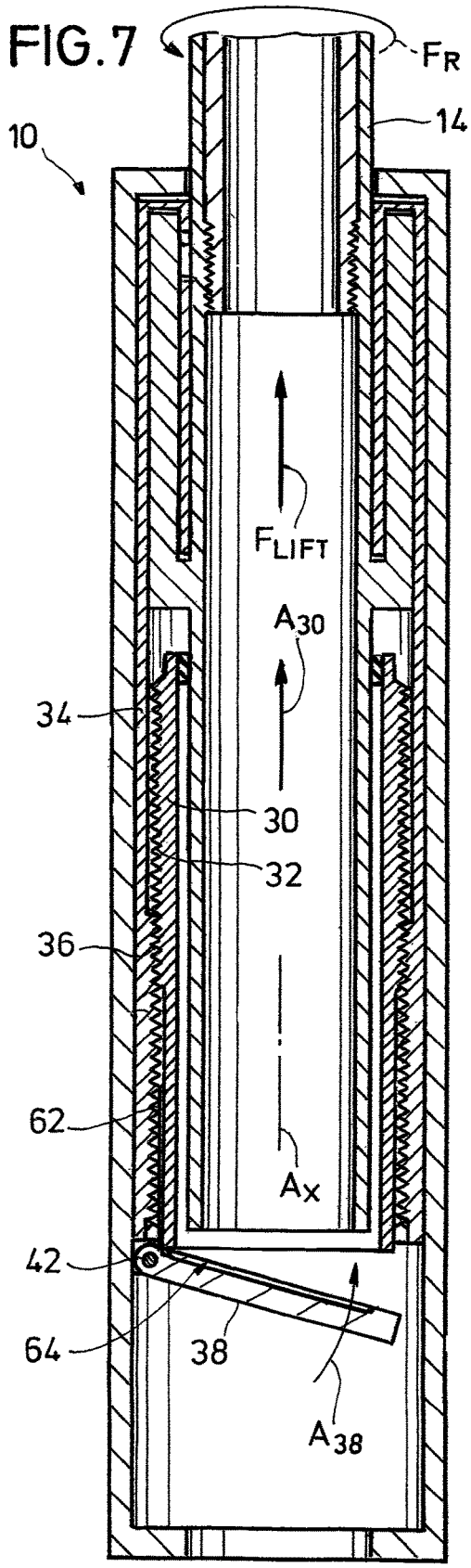
Figure 8:
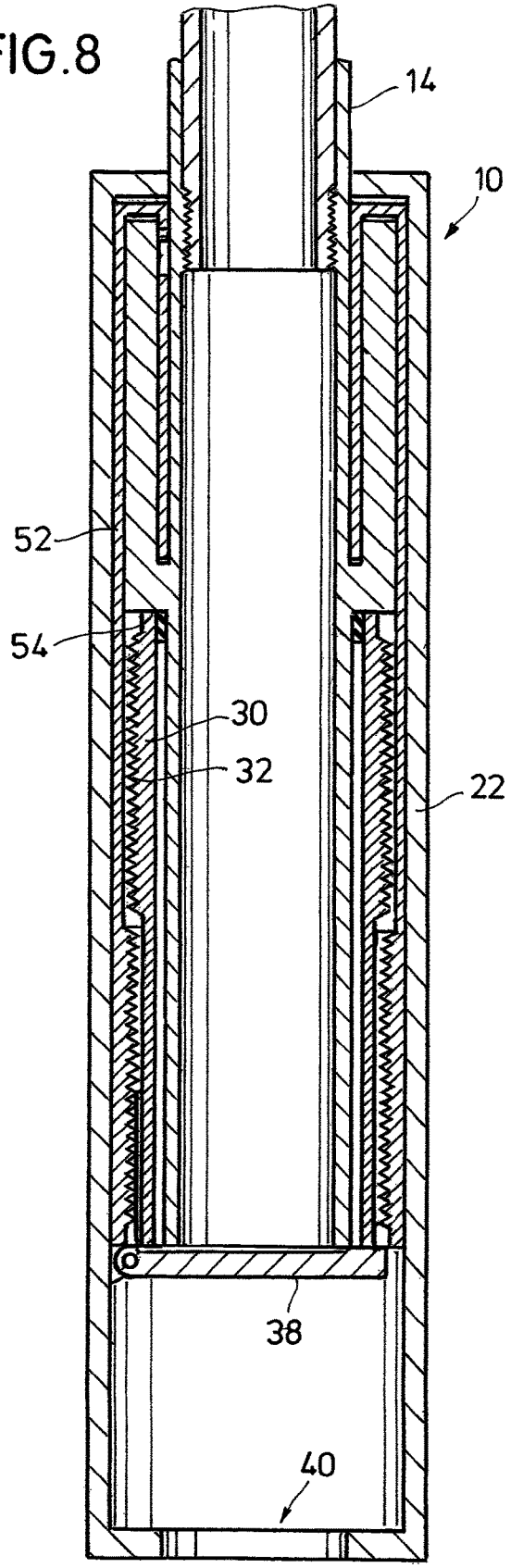

Shown in side sectional view in FIGS. 5 through 8 are example operational sequences for reconfiguring the valve assembly 10 in its open position of FIG. 4 and back to a closed configuration. In a non-limiting example of operation illustrated in FIG. 5 is that force $F_A$ is being applied to the production string 14 in an uphole direction (a direction opposite to that of FIG. 4). Via the threaded connection between threads 26, 28 shifting sleeve 24 is drawn uphole and within the housing of valve assembly by the uphole pulling of the production string 14. As shown in the example of FIG. 5 shifting sleeve 24 is freely moved upward with respect to the deployment sleeve 30, and deployment sleeve 30 remains engaged with the retraction sleeve 34 via the engagement between threads 32, 34. The length of slot 60 is dimensioned to allow axial travel of pin 58 and provides for a relative amount of axial movement between the shifting sleeve 24 and the retraction sleeve 34. In the example of FIG. 5 the location of pin 58 within slot 60 is at a location downhole from that of that illustrated in FIG. 2, and lower end 66 of shifting sleeve 24 is uphole of the opening 40 formed through the sidewall of housing 22. Continued upward movement brings the shifting sleeve 24 to its location within housing 22 of FIG. 3, and as shown in FIG. 6 collar 44 is substantially inserted within the annular space 50. Further shown in FIG. 6 is that a rotational force $F_R$ is being applied to the production string 14 that rotates the production string 14; by virtue of the rotational coupling between the shifting sleeve 24 and retraction sleeve 34 via the pin 58 and slot 60, the shifting sleeve 24 and the retraction sleeve 34 rotate when the production tubing 14 is rotated. In the illustrated example spline 62 of the deployment sleeve 30 is inserted within the channel 64 of the valve element 38, which is engaged with the housing 22 via the hinge assembly 42; insertion of the spline 62 into channel 64 coupling of valve element 38 to housing 22 by hinge assembly 42 couples deployment sleeve 30 to housing 22 and provides a counterforce to resist rotation of the deployment sleeve 30. In the example shown deployment sleeve 34 is rotatable with respect to the deployment sleeve 30 and the interaction between threads 32, 36 exerts an elevational lifting force $F_{LIFT}$ onto the deployment sleeve 30 with continued application of rotational force $F_R$ onto the production string 14. As shown in FIG. 7, the lifting force $F_{LIFT}$ repositions the deployment sleeve 30 uphole in the direction illustrated by $A_{30}$ and out of interfering contact with the valve element 38. As depicted schematically by arrow $A_{38}$ the spring (not shown) within the hinge assembly 42 biases the valve element 38 towards the closed configuration. FIG. 8 represents an example of the valve element having moved back to the closed configuration and which provides a barrier to a flow from opening 40 and into the production tubing 14 through the valve assembly 10.

Alternatives exist where instead of threads 32, 36 on the deployment and retraction sleeves 30, 34, flights or other helical members mount to one or both of these sleeves 30, 34. Further optionally, an example one of the sleeves 30, 34 is equipped with a mating surface (not shown) which deforms radially inward when put into axial contact with the flights or threads of the opposing one of the sleeves 30, 34 when one of the sleeves 30, 34 is being inserted into the other. The inward radial deformation allows axial insertion of one of the sleeves 30, 34 into the other, and by rotating one of the sleeves 30, 34 results in an elevational lifting force to axially urge the deployment sleeve 30 uphole within housing 22. Examples of mating surfaces include threads, flights, helically shaped elements, and a substrate formed from a pliable substance that forms complementary indentations when contacted by flights or threads of the opposing one of the sleeves 30, 34.

Figure 9:
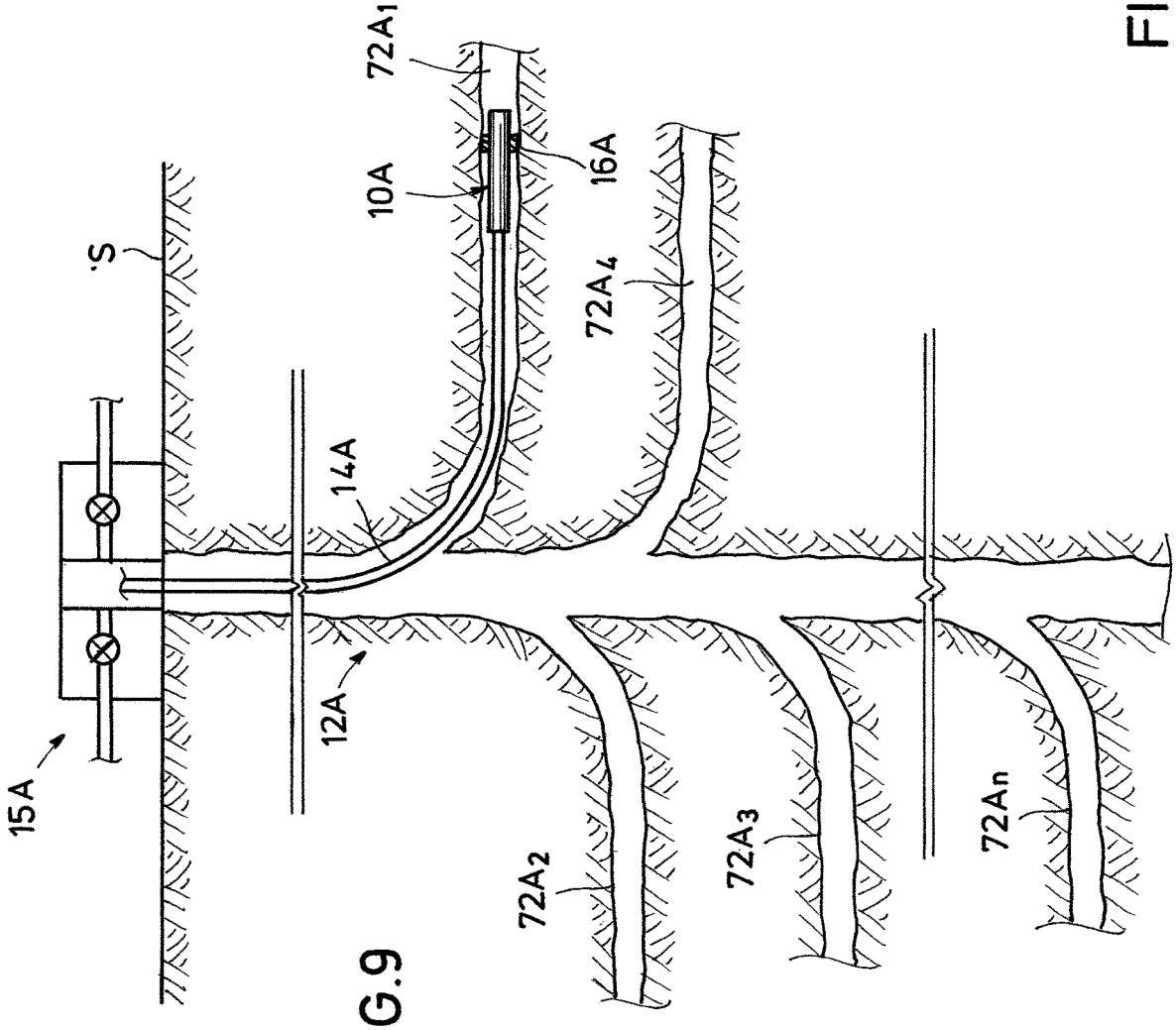
FIG. 9 is a side partial sectional view of an alternate example of the wellbore of FIG. 1.

In a side sectional view in FIG. 9 an alternate example of the valve assembly 10A is shown within a lateral bore $72A_1$; which is one of lateral bores $72A_2$, $72A_3$, $72A_4$, $72A_n$ that each project generally laterally from a main bore 12A. In this example, an end of the production string 14A is supported within the wellhead assembly 15A shown on surface; production string 14A curves into the lateral bore $72A_1$ and used for selectively blocking flow from within lateral bore $72A_1$ into main bore 12A.

Figure 10:
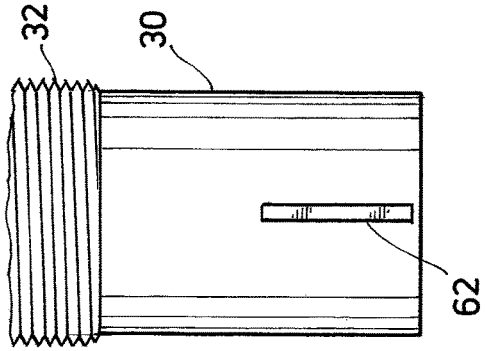
FIG. 10 is a side view of an example of a deployment sleeve for use with the isolation valve of FIGS. 1-8.
Figure 11:
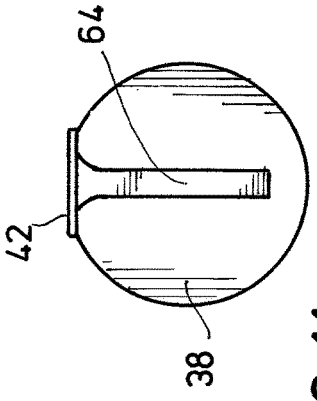
FIG. 11 is a plan view of an example of a valve element for use with the isolation valve of FIGS. 1-8.

FIG. 10 is a side view of one example of the shifting sleeve 30 and depicts the spline 62 extending axially along a portion of the outer surface of the deployment sleeve 30 and spaced away from the threads 32 that circumscribe the outer circumference of the sleeve 30. In FIG. 11 is overhead view of an example of the valve member 38 and in this example is shown with a substantially circular outer periphery and that the groove 64 extending along an upward facing surface of the valve element 38 and from adjacent where the hinge assembly 42 couples with valve element 38. Alternatively shown is that the width of the groove 62 expands proximate the outer periphery of valve element 38 to facilitate entry of spline 62 (FIG. 10) entering into groove 64. Further in this example, is that a forward end of the spline 62 is rounded to avoid sharp edges and promote ease of inserting of the spline 62 into groove 64.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A system for isolating a portion of a wellbore comprising:

a housing;

a valve element selectively changeable between a closed configuration in which the valve element is positioned in a path of fluid flow in the wellbore to define a barrier to fluid flow in the wellbore, and an open configuration in which the valve element is positioned away from the path of fluid flow in the wellbore;

a deployment sleeve axially moveable within the housing and selectively positioned adjacent the valve element when the valve element is in the open configuration so that the deployment sleeve interferes with the valve element being changed to the closed configuration; and a retraction sleeve disposed in the housing that is in lifting engagement with the deployment sleeve when the deployment sleeve is positioned adjacent the valve element, the deployment sleeve being axially insertable into the retraction sleeve so that when the retraction sleeve is rotated an elevational force is exerted onto the deployment sleeve to move the deployment sleeve away from the valve element.

2. The system of claim 1, further comprising a generally helical flight assembly coupled between the retraction sleeve and deployment sleeve, and through which the elevational force is transmitted from the retraction sleeve to the deployment sleeve.

3. The system of claim 2, wherein the helical flight assembly comprises a flight element that is mounted along a surface of the retraction sleeve that circumscribes an axis of the housing.

4. The system of claim 3, wherein the flight element comprises a first flight element, wherein the flight assembly further comprises a second flight element that is mounted along a surface of the deployment sleeve that circumscribes an axis of the housing and that engages the first flight element when the retraction sleeve is in lifting engagement with the deployment sleeve, and wherein the second flight element is radially compressible.

5. The system of claim 1, further comprising a shifting sleeve that is axially moveable within the housing and that is in abutting contact with the deployment sleeve so that sliding the shifting sleeve within the housing towards the deployment sleeve positions the deployment sleeve adjacent the valve element, and wherein the shifting sleeve is freely moveable away from the deployment sleeve in a direction away from the valve element.

6. The system of claim 1, further comprising a shifting sleeve that is axially moveable with respect to the retraction sleeve and rotationally coupled with the retraction sleeve by a pin and slot arrangement.

7. The system of claim 1, wherein the valve element comprises a disk like member that is hingedly affixed to an inner surface of the housing.

8. The system of claim 7, wherein the deployment sleeve is rotationally coupled with the valve element when the valve element is in the open configuration.

9. The system of claim 8, wherein rotationally coupling between the valve element and deployment sleeve is provided by insertion of a spline that projects radially outward from an outer surface of the deployment sleeve into a groove formed on a planar surface of the disk like member.

10. The system of claim 1, further comprising a string of production tubing that is rotationally coupled with the retraction sleeve and axially coupled with the deployment sleeve.

11. A system for isolating a portion of a wellbore comprising:

a string of production tubing;

an isolation valve assembly comprising, a housing having an uphole end coupled with the string of production tubing and an opening in communication with the wellbore on a downhole end that is distal from the uphole end, a shifting sleeve axially moveable within the housing, a valve element in the housing moveable from a closed configuration to an open configuration in response to downhole movement of the shifting sleeve, a retraction sleeve having a helical thread that circumscribes an axis of the housing, and a deployment sleeve that is selectively moveable downhole with downhole movement of the shifting sleeve to an opening location that interferes with movement of the valve element from the open configuration to the closed configuration, and into anchoring engagement with the helical thread; and a packer assembly circumscribing the housing.

12. The system of claim 11, wherein the shifting sleeve comprises a main body and a collar that circumscribes a portion of the main body to define an annular gap between the main body and collar.

13. The system of claim 12, wherein the retraction sleeve comprises a primary section and a bushing coaxially within the primary section to define an annular space between the primary section and the bushing, wherein the collar inserts into the annular space and the bushing inserts into the annular gap.

14. The system of claim 13, wherein the shifting sleeve and retraction sleeve are rotationally coupled by a pin attached to the collar that inserts into a slot formed axially along a length of the bushing.

15. The system of claim 11, wherein the shifting sleeve comprises a shoulder having a radial surface that is in abutting contact with an end of the deployment sleeve when the shifting sleeve is being moved downhole.

16. A system for isolating a portion of a wellbore comprising:

a housing selectively anchored in the wellbore and having a bore;

a valve element in the housing that is selectively in a closed position that is in interfering contact with flow through the bore, and selectively in an opened position that is away from interfering contact with the flow;

a deployment sleeve in the housing for selectively maintaining the valve element in the opened position;

a means for axially urging the deployment sleeve into a position for maintaining the valve element in the opened position;

a means for securing the deployment sleeve in the position for maintaining the valve element in the opened position, the means comprising a helical member, in which the deployment sleeve is selectively received within the helical member; and a means for retracting the deployment sleeve from the position for maintaining the valve in the opened position by rotating the helical member with respect to the deployment sleeve to generate a lifting force that urges the deployment sleeve axially away from the valve element and out of interference with the valve element moving into the closed position.

17. The system of claim 16, wherein the helical member comprises a first helical member, and wherein the means for retracting the deployment sleeve further comprises a second helical member that engages the first helical member.

18. The system of claim 16, wherein the helical member is mounted to an inner circumference of a retraction sleeve that is rotationally coupled to a string of production tubing.

19. The system of claim 16, wherein the means for axially urging the deployment sleeve into a position for maintaining the valve element in the opened position comprises a shifting sleeve that is axially moveable within the housing and comprises a collar with a downward facing shoulder that is in abutting contact with an end of the deployment sleeve, and wherein a portion of the shifting sleeve inserts into and past the deployment sleeve into contact with the valve element and urges the valve element into the opened position when urged axially downhole.

20. The system of claim 19, wherein the means for retracting the deployment sleeve from the position for maintaining the valve in the opened position comprises the shifting sleeve and a retraction sleeve that is rotationally coupled to the shifting sleeve and wherein the helical member comprises threads that are formed on an inner circumference of the retraction sleeve and that engage threads on an outer circumference of the deployment sleeve when the deployment sleeve is axially urged into the position for maintaining the valve element in the opened position, and wherein the threads on the outer circumference of the deployment sleeve are compressed radially inward when being engaged with the threads on the retraction sleeve.

* * * * *